US006608605B2

(12) United States Patent
Lee et al.

(10) Patent No.: US 6,608,605 B2
(45) Date of Patent: Aug. 19, 2003

(54) MULTI-BAND UNIFORM HELICAL ANTENNA AND COMMUNICATION DEVICE HAVING THE SAME

(75) Inventors: Man Wei Lee, Singapore (SG); Huan Fong Tan, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 4 days.

(21) Appl. No.: 10/016,470

(22) Filed: Dec. 10, 2001

(65) Prior Publication Data

US 2003/0107527 A1 Jun. 12, 2003

(51) Int. Cl.[7] ..... H01Q 1/36
(52) U.S. Cl. ..... 343/895; 343/745; 343/866
(58) Field of Search ..... 343/702, 745, 343/749, 750, 748, 866, 895; H01Q 1/24, 1/36, 9/36

(56) References Cited

U.S. PATENT DOCUMENTS

| | | | | | |
|---|---|---|---|---|---|
| 3,623,113 | A | * | 11/1971 | Faigen | 343/747 |
| 4,097,867 | A | * | 6/1978 | Eroncig | 343/715 |
| 5,504,494 | A | * | 4/1996 | Chatzipetros et al. | 343/702 |
| 5,963,180 | A | * | 10/1999 | Leisten | 343/895 |
| 5,990,848 | A | * | 11/1999 | Annamaa et al. | 343/895 |
| 6,011,525 | A | * | 1/2000 | Piole | 343/895 |
| 6,057,807 | A | * | 5/2000 | Marthinssson et al. | 343/895 |
| 6,111,554 | A | | 8/2000 | Chufarovsky et al. | 343/895 |
| 6,112,102 | A | | 8/2000 | Zhinong | 455/550 |
| 6,127,979 | A | | 10/2000 | Zhou et al. | 343/702 |
| 6,191,755 | B1 | * | 2/2003 | Hamaaratsu | 343/895 |

FOREIGN PATENT DOCUMENTS

| | | |
|---|---|---|
| EP | 0987788 | 3/2000 |
| GB | 2206243 | 12/1988 |
| WO | WO98/31069 | 7/1998 |

OTHER PUBLICATIONS

Patent Abstracts of Japan vol. 108, No. 255 (E–1548), May 16, 1994 & JP 06 037531 A (Sansei Denki KK; others: 02), Feb. 10, 1994.

* cited by examiner

*Primary Examiner*—Tho Phan
(74) *Attorney, Agent, or Firm*—Richard Main

(57) ABSTRACT

A helical antenna tuned to a first and a second resonant frequency is disclosed. The helical antenna includes an elongated conductor formed as a uniform spiral. The uniform spiral has a plurality of turns about a longitudinal axis. The plurality of turns has a predetermined pitch and the elongated conductor has a length which is approximately one-quarter of a wavelength of the first resonant frequency. The helical antenna further includes a first dielectric element and a second element. Both elements are coupled to the spiral to selectively tune the antenna to the second resonant frequency. A wireless communication device including the helical antenna is also disclosed.

6 Claims, 3 Drawing Sheets

MULTI-BAND UNIFORM HELICAL ANTENNA AND COMMUNICATION DEVICE HAVING THE SAME

FIELD OF INVENTION

This invention relates, generally, to an antenna and a communication device including the antenna. More specifically, this invention relates to an antenna adapted to operate in more than one frequency band and a communication device including the antenna.

BACKGROUND

With the increased use of wireless communication devices, radio frequency spectrum has become scarce. In many cases, network operators providing services on one particular band have had to provide service on a separate band to accommodate its customers. For example, network operators providing service on a GSM system in a 900 MHz frequency band have had to rely on a DCS system at an 1800 MHz frequency band. Accordingly, wireless communication devices, such as cellular radio telephones, must be able to communicate at both frequencies, or even a third system, such as PCS at a 1900 MHz frequency band. Such a requirement to operate at two or more frequency bands creates a need for a wireless communication device that has an antenna adapted to receive signals on more than one frequency band.

Also, as wireless communication devices decrease in size, there is also a need to reduce the size of an antenna associated with the device. Further, while an extendible antenna offers certain advantages, such an antenna poses problems to an end user. Because the antenna will typically perform better when in the extended position, the user is required to extend the antenna before operating the wireless communication device. Many end users however prefer a fixed or "stubby" antenna which do not need to be extended during operation. Accordingly, there is a need for an antenna adapted to receive signals well in multiple frequency bands without extension.

An example of such an antenna is a non-uniform helical antenna tuned to a first and a second resonant frequency as disclosed in U.S. Pat. No. 6,112,102. The non-uniform helical antenna includes a single elongated conductor that is formed into a spiral having a first section and a second section. The first section and the second section have turns of different pitches. The pitches are selected to tune the non-uniform helical antenna to the second resonant frequency. This non-uniform helical antenna suffers from a disadvantage. It is difficult to adjust the turns of the spiral to produce the different pitches.

SUMMARY

According to an embodiment of the present invention, there is provided a helical antenna tuned to a first and a second resonant frequency. The helical antenna includes an elongated conductor formed as a uniform spiral. The uniform spiral has a plurality of turns about a longitudinal axis. The plurality of turns has a predetermined pitch and the elongated conductor has a length which is approximately one-quarter of a wavelength of the first resonant frequency. The helical antenna further includes a first dielectric element and a second element. Both the elements are coupled to the spiral to selectively tune the antenna to the second resonant frequency.

According to another embodiment of the present invention, there is provided a wireless communication device adapted to operate in at least two frequency bands. The wireless communication device includes a helical antenna as described above connected to a transceiver.

BRIEF DESCRIPTION OF DRAWINGS

The invention will be better understood with reference to the drawings, in which.

DETAILED DESCRIPTION OF THE PREFERRED EMBODIMENT

Figure 1:
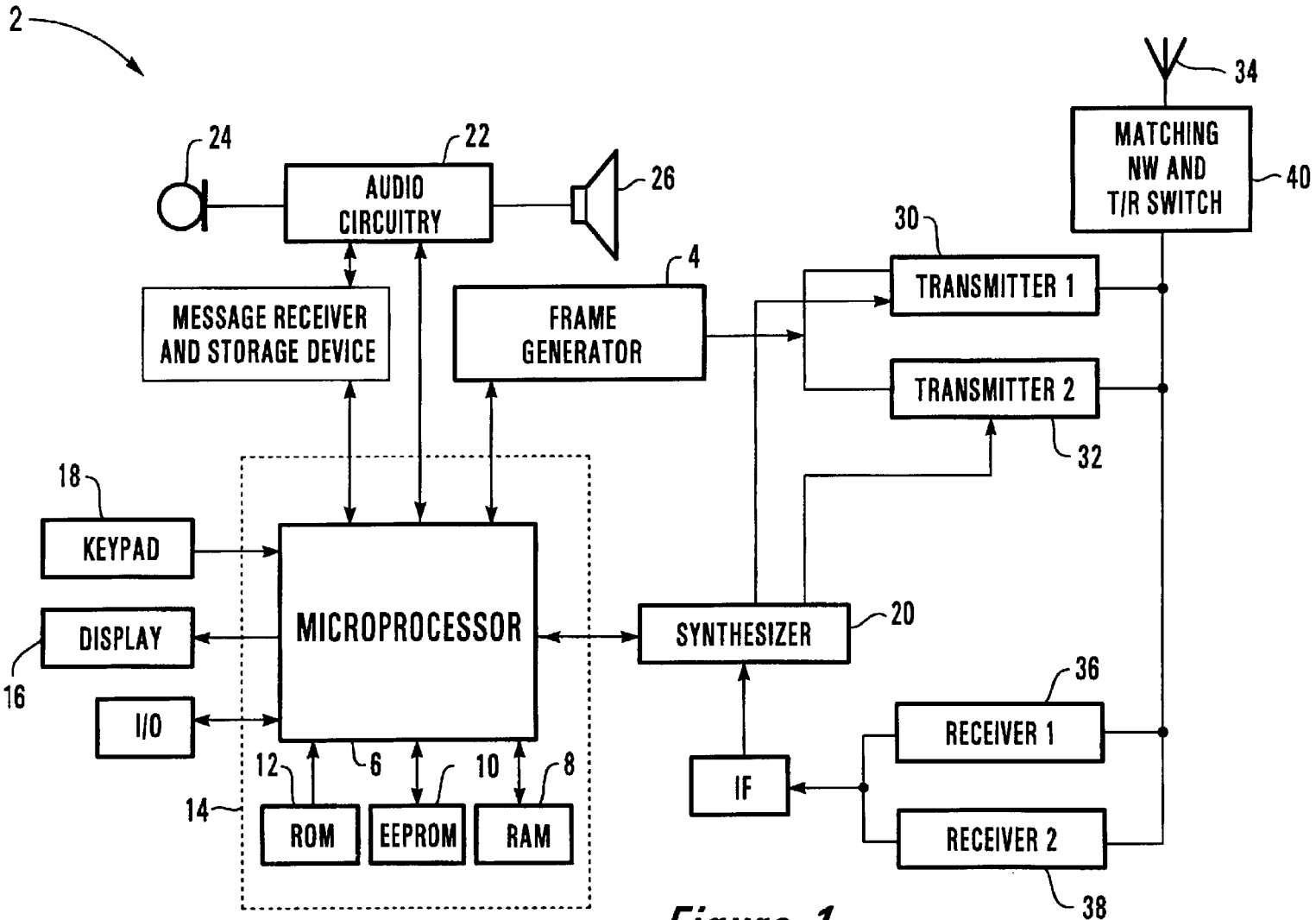
FIG. 1 is a block diagram of a wireless communication device having an antenna according to the present invention.

FIG. 1 shows a block diagram of a wireless communication device 2 such as a dual band cellular radio telephone adapted to operate over two different frequency bands. Those skilled in the art know that each frequency band is divided into multiple frequency channels. For example, in the AMPS standard promulgated for the United States, the frequency band includes a sub-frequency band for downlink channels and another sub-frequency band for uplink channels.

The wireless communication device 2 includes a frame generator ASIC 4 that cooperates with a microprocessor 6 to generate the necessary communication protocol for operating in a cellular system. The device 2 also includes memories such as a RAM 8, an EEPROM 10, and a ROM 12. These memories 8, 10, 12 and the microprocessor 6 are preferably consolidated in a single package 14. The microprocessor 6 uses the memories 8,10, 12 to execute the steps necessary to generate the protocol and to perform other functions of the device 2. The functions include writing to a display 16, accepting information from a keypad 18, controlling a frequency synthesizer 20, or performing steps necessary to amplify a signal and other functions known to those skilled in the art. The ASIC 4 processes audio data from an audio circuitry 22 connected to a microphone 24 and to a speaker 26.

A transceiver processes signals at the two frequency bands. In particular, transmitters 30, 32 transmit through an antenna 34 signals that are modulated using carrier frequencies produced by the frequency synthesizer 20. Modulated signals received by the antenna 34 is received by the receivers 36, 38 through a matching network and a transmit/receive switch 40. The receivers 36, 38 demodulate the received modulated signals using the carrier frequencies from the frequency synthesizer 20 to produce demodulated signals. The transmitters and receivers are collectively called a transceiver.

Figure 2A:
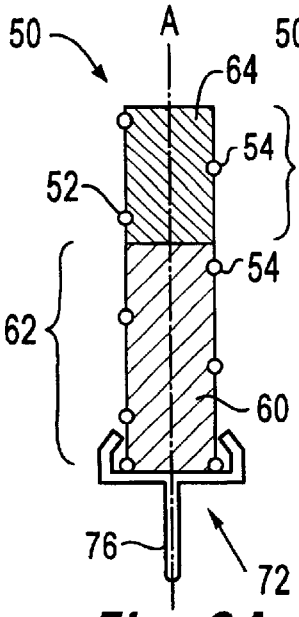
FIGS. 2A–2E are sectional drawings of several embodiments of the antenna that can be used with the wireless communication device in FIG. 1.
Figure 2B:
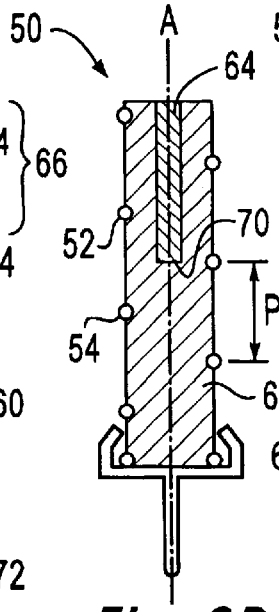
Figure 2C:
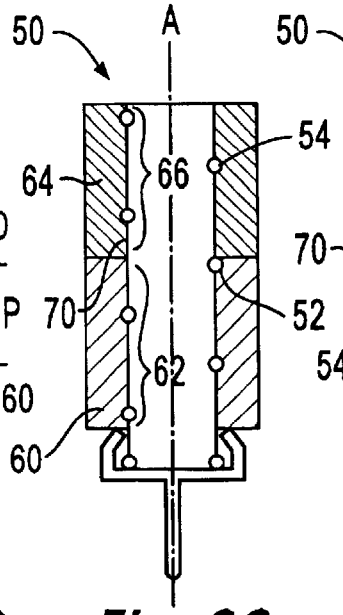
Figure 2D:
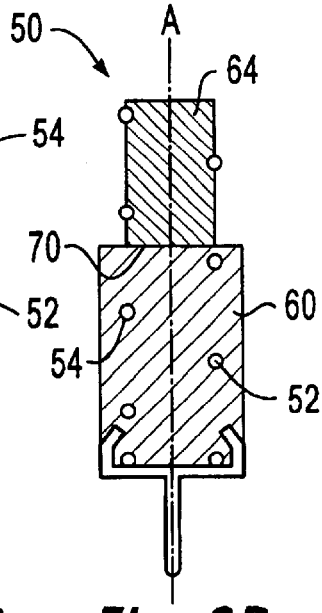
Figure 2E:
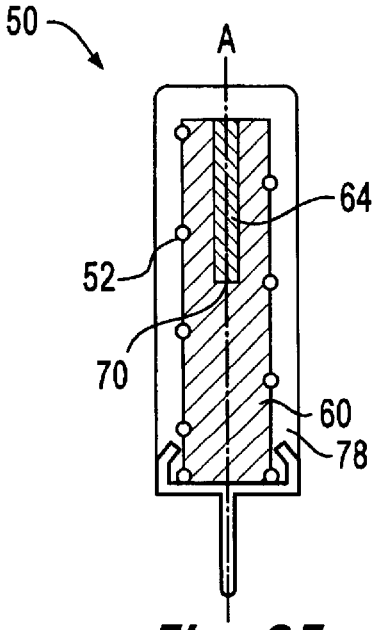

FIGS. 2A–2E show different embodiments of a helical antenna 50 according to the present invention that can be used as the antenna 34 of the wireless communication device 2 described above. The helical antenna 50 is tuned to a first and a second resonant frequency associated with the two frequency bands. The helical antenna 50 includes an elongated conductor 51 (FIG. 3D) formed as a helical structure, also known as a spiral 52, about a longitudinal axis A. The spiral 52 has a plurality of turns 54 of a predetermined pitch P (FIG. 2B). The elongated conductor 51 has an uncoiled length L1 (FIG. 3D) which is approximately one-quarter of a wavelength of the first resonant frequency. The helical antenna 50 includes a first dielectric element 60 coupled to a first section 62 of the spiral 52. The helical antenna 50 also includes a second element 64 coupled to a second section 66 of the spiral 52. Coupling refers to positioning the first dielectric element 60 and the second element 64 with respect to the spiral 52 to change the distributed capacitance and inductance of the helical antenna 50. The first and second sections 62, 66 of the spiral 52 may overlap as shown in FIG. 2B. The first dielectric element 60 and the second element 64 are preferably proximally disposed in single file along a common axis as shown in FIGS. 2A–2E. The elements 60, 64 may preferably be disposed inside the spiral 52 to form a multi-sectional core of the antenna 50 as shown in FIGS. 2A, 2B and 2E. The first dielectric element 60 may either be spaced apart from the second element 64. Alternatively, the elements 60, 64 may be disposed end to end having respective end surfaces that abut as shown in the figures.

In the end to end arrangement of the elements 60, 64, the second element 64 has an end surface 70 which is in abutment with the first dielectric element 60 at a predetermined position with respect to the spiral 52 to selectively tune the helical antenna 50 to the second resonant frequency. The process for tuning the embodiment of the helical antenna 50 shown in FIG. 2B will be described shortly. The first dielectric element 60 may be of santaprene, polypropylene, Delrin, Teflon or the like. The second element 64 may be of a dielectric material that is different from the first dielectric element 60. Alternatively, the second element 64 may be a conductor. When a conductor is used, the second element 64 is electrically isolated from the spiral 52 to avoid shorting the turns 54 of the spiral 52. A metal supporting member 72 having a barrel 74 attached to a stem 76 is used to support the helical antenna 50. The barrel 74 is crimped with an end of the spiral 52 inserted therein to firmly grip and support the helical antenna 50. The stem 76 connects the helical antenna 50 to the matching network and the transmit/receive switch 40.

According to the embodiment shown in FIG. 2A, the first dielectric element 60 and the second element 64 are disposed inside the spiral 52. This arrangement of the elements 60, 64 allows the elements 60, 64 to couple with the respective sections 62, 66 of the spiral 52. A track or groove may be cut on an outside surface of the elements 60, 64 to allow the turns 54 of the spiral 52 to be screwed thereon. In this manner, the elements 60, 64 can be inserted inside the spiral 52 and both the elements 60, 64 may be aligned along the longitudinal axis A of the spiral 52. The elements 60, 64 in the embodiment in FIG. 2A have similar cross-sections and are in end to end abutment with each other. The total length of the elements 60, 64 along the longitudinal axis A is substantially equal to a longitudinal length L2 (FIG. 3A) of the spiral 52.

According to the embodiment shown in FIG. 2B, the first dielectric element 60 has a length substantially equal to the longitudinal length L2 of the spiral 52 and is inserted inside the spiral 52. The first dielectric element 60 has a slot defined therein to receive the second element 64. The slot has a base that preferably abuts the end surface 70 of the second element 64.

According to the embodiment shown in FIG. 2C, the first dielectric element 60 and the second element 62 are sleeves that cover the respective sections 62, 66 of the spiral 52. And according to the embodiment in FIG. 2D, the first dielectric element 60 encloses the first section 62 of the spiral 52. FIG. 2E shows the embodiment in FIG. 2B molded over with a plastic 78.

Figure 3D:
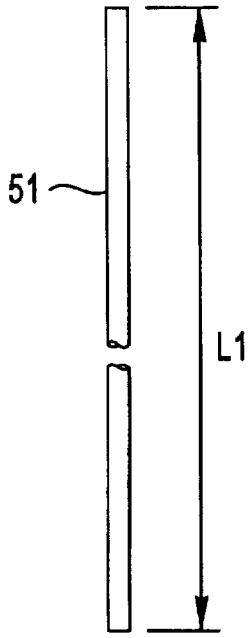
FIGS. 3A–3D are drawings showing one of the embodiments of the antenna at different stages of its construction.

Techniques for tuning the embodiment of the helical antenna 50 in FIG. 2B to two (or more) resonant frequencies are based on the principle of changing the distributed capacitance and inductance of the helical antenna 50 to obtain the two (or more) desired resonant frequencies. More specifically, the physical parameters of the helical antenna 50 are adjusted in order to change the distributed capacitance and inductance. These parameters will now be discussed with the aid of FIGS. 3A–3D and FIGS. 4A–4C. FIG. 3D shows the conductor 51 in an uncoiled state that is used to create the helical structure or spiral 52. The conductor 51 has a length L1 which determines the first and lower resonant frequency of the spiral 52. The length L1 allows the spiral 52 to operate as a quarter wavelength monopole antenna at the lower resonant frequency. L1 could therefore be chosen to be about 83 mm to create a dual band helical antenna 50 that is tuned to, for example, about 900 MHz as a lower resonant frequency 90 (FIG. 4A).

Figure 3A:
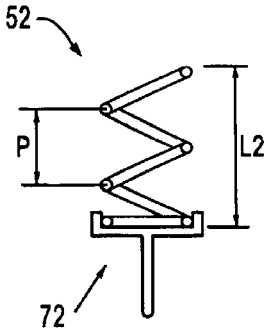
Figure 4A:
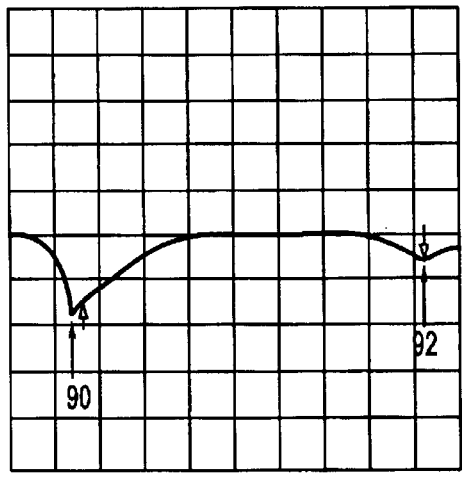
FIGS. 4A–4C are graphs showing the return loss as a function of frequency of the antenna at different stages of its construction according to FIGS. 3A–3C.

To compact the conductor 51, it is coiled into the spiral 52 having the longitudinal length of L2 as illustrated in FIG. 3A. L2 can be, for example, about 20 mm using the conductor length L1 of about 83 mm. L2 is typically constrained by the industrial design of the wireless communication device 2. With such a spiral 52 having a constant pitch P and constant helix diameter along its length, a second and higher resonant frequency 92 would typically occur at about three-quarters of a wavelength. In the example described here, where the length L1 was selected to result in the lower resonant frequency 90 of 900 MHz, the higher resonant frequency 92 of the spiral 52 would be about 2700 MHz as shown in FIG. 4A. However, a different higher resonant frequency 92 would normally be desirable. For example, as described above, it may be desirable to have a higher resonant frequency 92 of about 1800 MHz instead of 2700 MHz, if a wireless communication device designer wants a helical antenna 50 for usage in the DCS system.

Figure 3B:
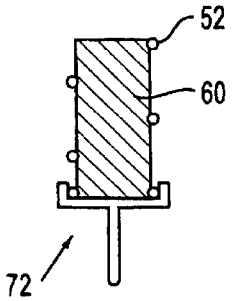
Figure 4B:
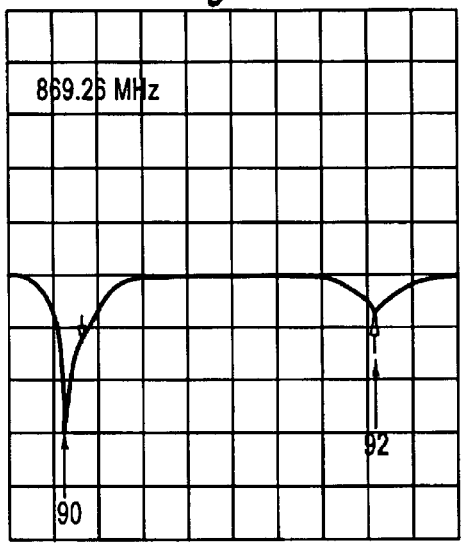
Figure 3C:
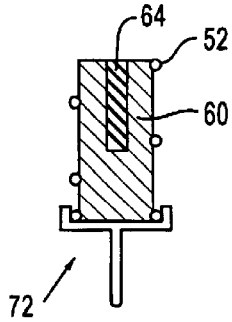
Figure 4C:
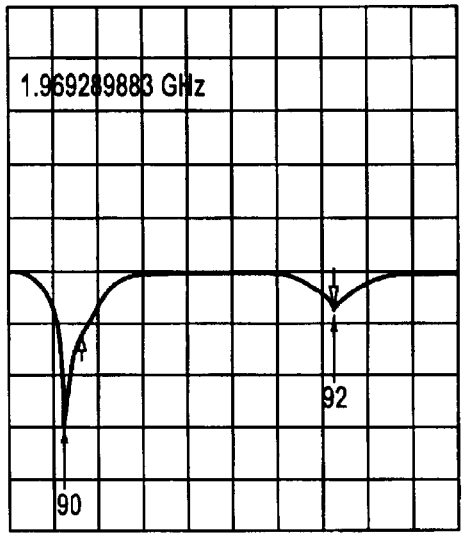

A first step in tuning the spiral 52 is to consider the effects of a chassis (not shown) of the wireless communication device 2 and the supporting member 72 on the higher resonant frequency 92. Typically, the chassis and the supporting member 72 will also act as an antenna which will tend to lower the higher resonant frequency 92, for example, from 2700 MHz to 2400 MHz in the example discussed above. To further lower the higher resonant frequency 92, it is thus desirable to increase the coupling (i.e., capacitive and inductive coupling) between the turns 54 of the spiral 52. According to one embodiment of the present invention, this is accomplished by selecting the first dielectric element 60, for example of Delrin, and inserting the first dielectric element 60 inside the spiral 52 as shown in FIG. 3B. The coupling between the spiral 52 and the first dielectric element 60 lowers the higher resonant frequency 92 to about 2140 MHz as shown in FIG. 4B. Next a slot (shown filled with the second element 64 in FIG. 3C) of a predetermined diameter and depth is created at one end of the first dielectric element 60. Creating the slot in the first dielectric element 60 has the tendency to increase the higher resonant frequency 92. Next the second element 64 of approximately the same dimension as the slot is inserted into the slot. The second element 64 may be of Polyetheimide (PEI) with a higher dielectric constant than Delrin. Alternatively, the second element 64 may be a conductor such as copper. Introduction of the second element 64 lowers the higher resonant frequency 92 to about 1970 MHz as shown in FIG. 4C. The dimensions, i.e., depth, length or both, of the slot and therefore the second element 64 can be changed accordingly to further lower the higher resonant frequency 92 to the desired value. Those skilled in the art know that the technique for tuning the uniform helical antenna 50 to the second (and any additional) resonant frequency is somewhat experimental and iterative in nature. Those skilled in the art also know of techniques to tune the uniform helical antenna 50 to obtain the frequency bands around the first and second resonant frequencies.

Advantageously, the uniform helical antenna 50 according to the present invention is relatively easy to tune and manufacture as compared to a multi-band non-uniform helical antenna in the prior art.

While the present invention has been shown and described with reference to the foregoing operational principles and preferred embodiment, it will be apparent to those skilled in the art that other changes in form and detail may be made. As an example, a multi-band uniform helical antenna turned to operate in only two frequency bands is described. Those skilled in the art will appreciate the technique described above can be extended to allow operation in three or more different frequency bands, for example, by adding additional turns to the spiral 52 and introducing more dielectric elements to selectively tune the spiral 52 to three or more different resonant frequencies.

We claim:

1. A multi-band helical antenna, comprising:

a first section attached to a whip-antenna connection base;

a second section adjacent to and distal from the first section;

a helical coil electrically connected to said whip-antenna connection base and extending through both the first and second sections, and having a uniform winding pitch and diameter throughout;

a first core of a first dielectric material at least disposed in the first section and that imposes a first distributed inductance and capacitance effect on a near-end part of the helical coil;

a second core of a second dielectric material having a different dielectric constant than that of said first dielectric material, and disposed only in the second section, and abutting the first core, and further that imposes a second distributed inductance and capacitance effect on a distal-end part of the helical coil;

wherein, the antenna has a first resonance at 0.25 wavelengths of a first frequency, and a second resonance at 0.75 wavelengths of a different and higher second frequency that is substantially lower than the third harmonic of the first frequency, and does not resonate at 0.75 wavelengths of said first frequency.

2. The multi-band helical antenna according to claim 1, wherein:

the first core comprises a first dielectric material of Delrin; and the second core comprises a second dielectric material of Polytheimide (PEI) with a higher dielectric constant than Delrin.

3. The multi-band helical antenna according to claim 1, wherein:

said first resonance is about 900 MHz; and said second resonance is about 1800 MHz.

4. A multi-band helical antenna, comprising:

a first section attached to a whip-antenna connection base;

a second section adjacent to and distal from the first section;

a helical coil electrically connected to said whip-antenna connection base and extending through both the first and second sections, and having a uniform winding pitch and diameter throughout;

a first core of a dielectric material at least disposed in the first section and that imposes a first distributed inductance and capacitance effect on a near-end part of the helical coil;

a second core of a conductive material electrically insulated to prevent shorting of the helical coil, and disposed only in the second section, and abutting the first core, and further that imposes a second distributed inductance and capacitance effect on a distal-end part of the helical coil;

wherein, the antenna has a first resonance at 0.25 wavelengths of a first frequency, and a second resonance at 0.75 wavelengths of a different and higher second frequency that is substantially lower than the third harmonic of the first frequency, and does not resonate at 0.75 wavelengths of said first frequency.

5. A method for making a helical antenna resonate at two frequencies other than its quarter-wave fundamental and three-quarter-wave third harmonic frequencies, comprising:

disposing a first core of a first dielectric material at least disposed in a first section of a helical coil and that imposes a first distributed inductance and capacitance effect on a near-end part of the helical coil;

disposing a second core of a second dielectric material in a second section of said helical coil and that imposes a second distributed inductance and capacitance effect on a distal-end part of said helical coil;

wherein, an antenna comprising said helical coil has a first resonance at 0.25 wavelengths of a first frequency, and a second resonance at 0.75 wavelengths of a different and higher second frequency that is substantially lower than the third harmonic of the first frequency, and does not resonate at 0.75 wavelengths of said first frequency.

6. A multi-band radio, comprising:

a radio receiver for operating on a first and a second radio frequency band in which said second radio frequency band is substantially less than the third harmonic of said first radio frequency band;

a first section attached to an antenna connection base attached to the radio receiver;

a second section adjacent to and distal from the first section;

a helical coil electrically connected to said antenna connection base and extending through both the first and second sections, and having a uniform winding pitch and diameter throughout;

a first core of a first dielectric material at least disposed in the first section and that imposes a first distributed inductance and capacitance effect on a near-end part of the helical coil;

a second core of a second dielectric material having a different dielectric constant than that of said first dielectric material, and disposed only in the second section, and abutting the first core, and further that imposes a second distributed inductance and capacitance effect on a distal-end part of the helical coil;

wherein, the helical coil has a first resonance at 0.25 wavelengths of a first frequency in said first radio frequency band, and a second resonance at 0.75 wavelengths of a different and higher second frequency that is substantially lower than the third harmonic of the first frequency and in said second radio frequency band.

* * * * *